United States Patent [19]

Artzberger

[11] Patent Number: 4,927,289

[45] Date of Patent: May 22, 1990

[54] VIBRATORY MECHANISM FOR A COMPACTION ROLLER

[75] Inventor: Thomas G. Artzberger, Menomonee Falls, Wis.

[73] Assignee: M-B-W Inc., Slinger, Wis.

[21] Appl. No.: 342,539

[22] Filed: Apr. 24, 1989

Related U.S. Application Data

[63] Continuation-in-part of Ser. No. 210,911, Jun. 24, 1988, abandoned.

[51] Int. Cl.[5] ..... E01C 19/26

[52] U.S. Cl. ..... 404/117; 404/122; 404/127; 404/132

[58] Field of Search ..... 404/132, 117, 103, 130, 404/122, 127; 74/61, 87

[56] References Cited

U.S. PATENT DOCUMENTS

| | | | |
|---|---|---|---|
| 2,549,182 | 4/1951 | Ekenstam | 404/132 |
| 2,728,277 | 12/1955 | McRae | 404/117 |
| 3,000,278 | 9/1961 | Kaltenegger | 404/117 |
| 3,108,520 | 10/1963 | Garis et al. | 404/132 |
| 3,426,660 | 2/1969 | Scott | 404/117 |
| 3,516,341 | 6/1970 | Olsen | 404/103 |
| 3,543,656 | 12/1970 | Roettger | 404/117 |
| 3,595,145 | 7/1971 | Mozdzanowski | 404/117 |
| 3,814,531 | 6/1974 | Carnahan et al. | 404/117 |
| 4,610,567 | 9/1986 | Hosking | 404/132 |
| 4,647,247 | 3/1987 | Sandstrom | 404/75 |
| 4,732,507 | 3/1988 | Artzberger | 404/117 |

FOREIGN PATENT DOCUMENTS

| | | |
|---|---|---|
| 1278558 | 10/1961 | France . |
| 1336783 | 7/1963 | France . |
| 384019 | 11/1964 | Switzerland . |

*Primary Examiner*—Jerome W. Massie
*Assistant Examiner*—Gay Ann Spahn
*Attorney, Agent, or Firm*—Andrus, Sceales, Starke & Sawall

[57] ABSTRACT

A compaction apparatus including a pair of frames. A compaction drum is mounted for rotation on a first of the frames and resilient isolation mounts interconnect the two frames. A vibratory unit is mounted on the first frme and includes pair of eccentric weights arranged so that vertical vibratory forces generated by the weights are added, while fore-and-aft vibratory forces are cancelled. The isolation mounts are at different distances on opposite sides of a vertical plane passing through the axis of the drum, so that the vertical vibratory forces acting through the two isolation mounts produce unequal moments tending to rotate the drum and subject the soil to a shear-type action.

11 Claims, 2 Drawing Sheets

FIG. 1
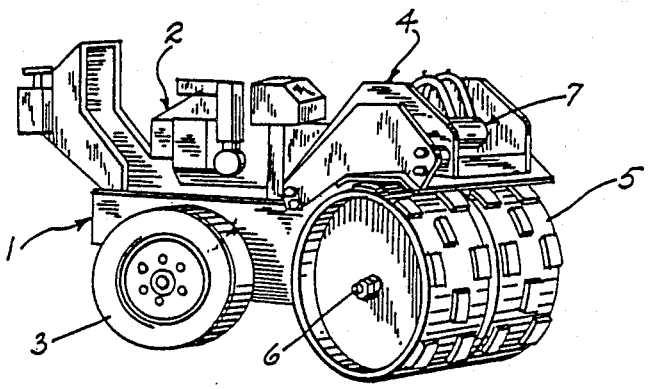
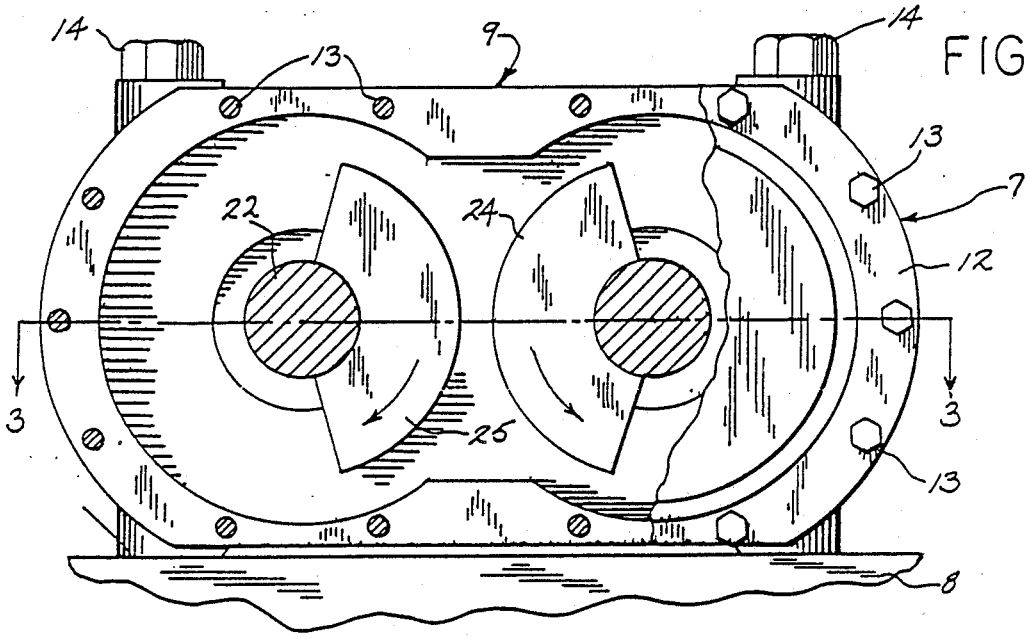
FIG. 2
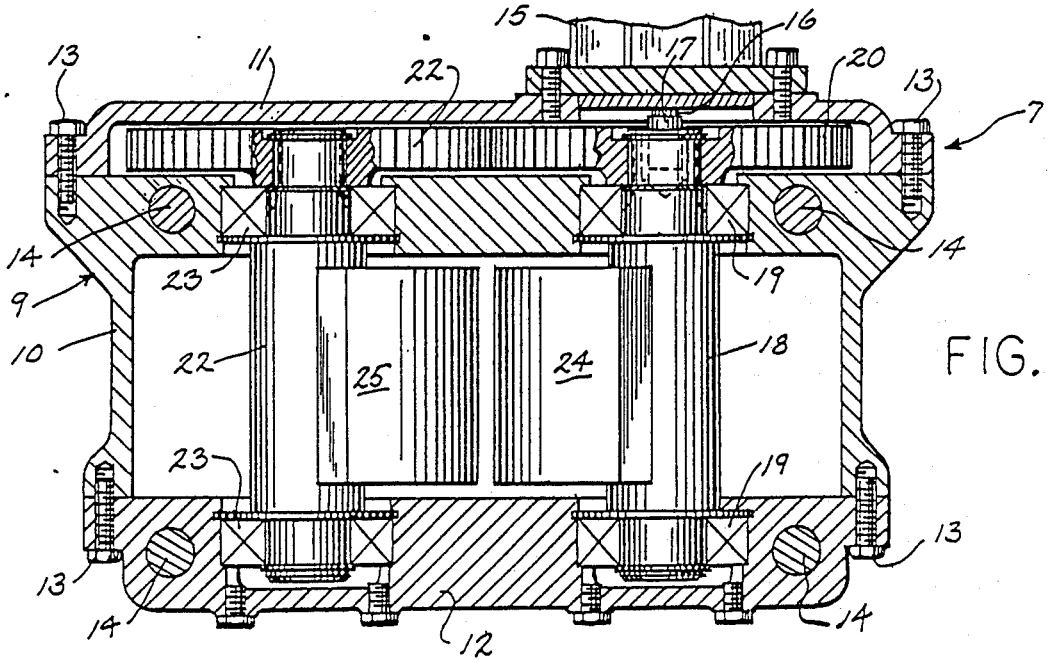
FIG. 3

VIBRATORY MECHANISM FOR A COMPACTION ROLLER

RELATED APPLICATION

This application is a continuation-in-part of application Ser. No. 219,911, filed June 24, 1988, abandoned June 13, 1989.

BACKGROUND OF THE INVENTION

The typical self-propelled compaction roller includes a main frame or chassis that supports an engine which serves to operate drive wheels to propel the roller over the terrain. A drum frame is pivotally connected by a universal joint to the main frame and rotatably supports a compaction drum or roller. A vibratory mechanism is mounted on the drum frame and acts to vibrate the drum to aid in compaction.

A common type of vibratory mechanism includes a hydraulic motor and a weight is mounted eccentrically with respect to the output shaft of the motor. The eccentric weight generated vibratory forces throughout the 360° rotation of the shaft, While the vertical vibratory forces aid in compaction, the fore and aft vibratory forces are transmitted through the machine and can cause severe wear and maintenance problems. In an attempt to isolate the vibrations from the main frame to the machine, shock mounts are utilized to connect the drum to the main frame, as well as mounting the engine on the main frame.

As a further problem, when the forces are generated throughout the 360° rotation of the shaft, harmonic vibrations may be set up, which act to cancel out the vertical vibratory forces, so that the compaction forces are not maximized.

It is known to employ a separate vibratory unit or exciter for each drum in a double drum compaction roller. In a unit of this type an eccentric weight is mounted on each output shaft and the weights are arranged so that when a downward vertical vibratory force is generated by one eccentric weight, an upward vertical vibratory force is generated by the other weight. The result is that the compaction forces are generated in sequence, and the sequenced vibrations are desirable in certain applications, as in asphalt paving operations, to eliminate skip marks.

It is also known, as disclosed in U.S. Pat. No. 4,647,247, to mount eccentric weights within a compaction drum, in a manner such that the vertical vibratory forces generated by the eccentric weights will cancel, while the horizontal or fore-and-aft vibratory forces add together to provide a shearing type of action on the soil.

SUMMARY OF THE INVENTION

The invention is directed to an improved vibratory compaction roller. The compaction roller includes a main frame, which supports an engine that is operably connected to drive wheels that act to propel the roller over the terrain. A forward frame is connected to the main frame by an articulated or universal joint so that the forward frame can pivot both in a vertical, as well as a horizontal direction relative to the main frame.

A drum frame carries a compaction drum and is connected to the forward frame by forward and rear resilient isolation mount assemblies, which minimize the transmission of vibrations from the drum frame to the forward frame, as well as to the main frame.

Mounted on the drum frame directly above the drum is an exciter or vibratory mechanism. The vibratory mechanism is provided with a housing, and a pair of parallel shafts are journalled within the housing. A separate power unit, such as a hydraulic motor, is operably connected to one of the shafts to drive the same, while a gear train connects the shaft with a second shaft, so that the shafts operate in opposite directions and at the same speed.

An eccentric weight is connected to each shaft and the weights are preferably formed to identical shape and size. The weights are arranged on the shafts so that the vertical vibratory forces generated by the weights during rotation of the shafts are added, while the fore and aft vibratory forces generated by the weights are cancelled. To provide this arrangement, the center mass of one weight is disposed above and in a vertical plane extending through the axis of the respective shaft when the center of the mass of the other weight is disposed above and in a vertical plane extending through the axis of the corresponding shaft.

In accordance with the construction of the invention, the drum frame and vibratory mechanism are supported form the forward frame solely through the resilient isolation mounts. The rear isolation mounts are located a greater distance from the vertical plane passing through the axis of the drum than are the forward isolation mounts and, therefore, the downward vibratory force acts through moment arms of different lengths in transmitting the downward force to the drum. The resulting difference is moments tends to rotate the drum forwardly as it is forced downwardly thereby providing a shearing action on the soil to aid in compaction. Thus, the invention provides improved compaction efficiency by combining a shear action with the downward vertical vibratory forces.

With the construction of the invention, the horizontal or fore and aft vibrations are substantially eliminated, thereby minimizing the transmission of vibrations to the main frame of the shaft. As the transmission of unwanted vibrations to the main frame is minimized, wear and maintenance of the machine is substantially reduced.

As a further advantages, the shock mounts which interconnect the drum frame to the main frame, can be reduced in complexity, due to the fact that the shock mounts resist primarily vertical vibratory motion as opposed to resisting universal vibratory motion as in a conventional compactor roller.

Further, the drum shaft, which journals the compaction drum is primarily subjected to vertical stress and this substantially reduces the wear on the shaft bearings, as well as on the universal joint.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of a compaction roller incorporating the vibratory mechanism of the invention;

FIG. 2 is a front elevational view of the vibratory mechanism, with parts broken away in section;

FIG. 3 is a section taken along line 3—3 of FIG. 2;

DESCRIPTION OF THE ILLUSTRATED EMBODIMENT

Figure 4:
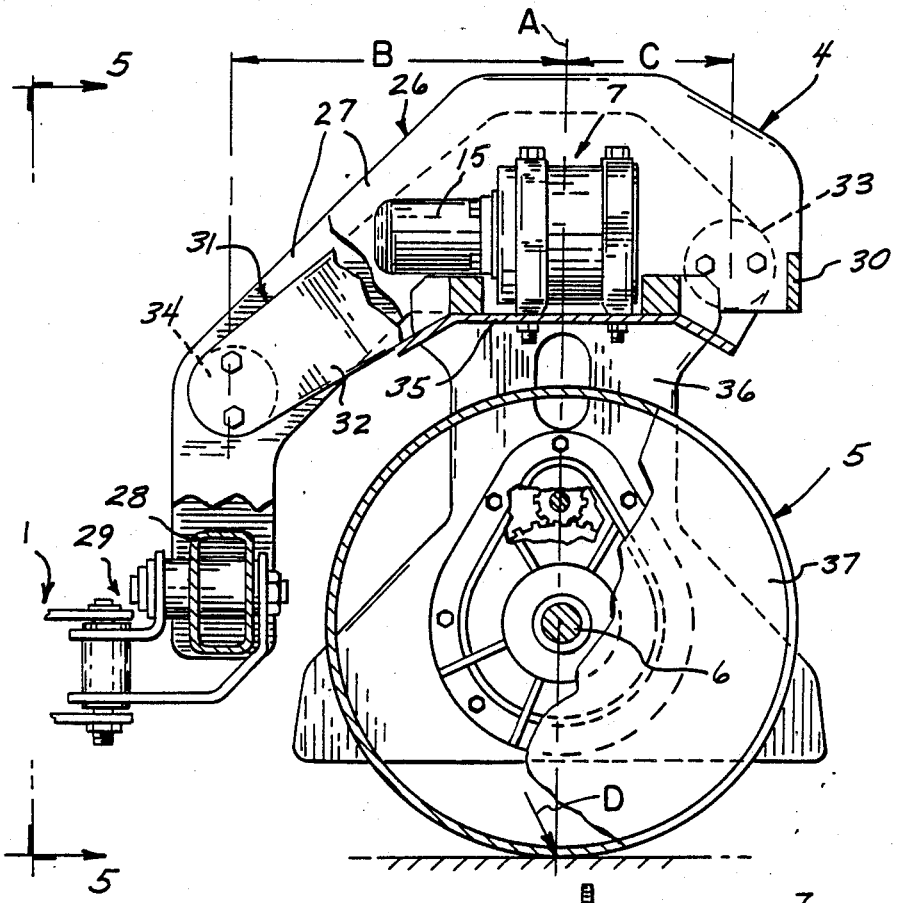
FIG. 4 is a fragmentary side elevation of the compactor with parts broken away.

FIG. 1 illustrates a compaction roller incorporating the vibratory or exciter mechanism of the invention. The compaction roller itself can be constructed in the manner described in U.S. Pat. No. 4,732,507 and consists of a main frame 1 which supports an engine 2 and the engine is operably connected to the drive wheels 3 which are journalled on the frame 1. Operation of the engine 2 will propel the roller over the terrain.

A front unit 4 is connected to the forward end of main frame 1 and a drum 5 is journalled on shaft 6 that is carried by front unit 4, as seen in FIG. 1.

Figure 5:
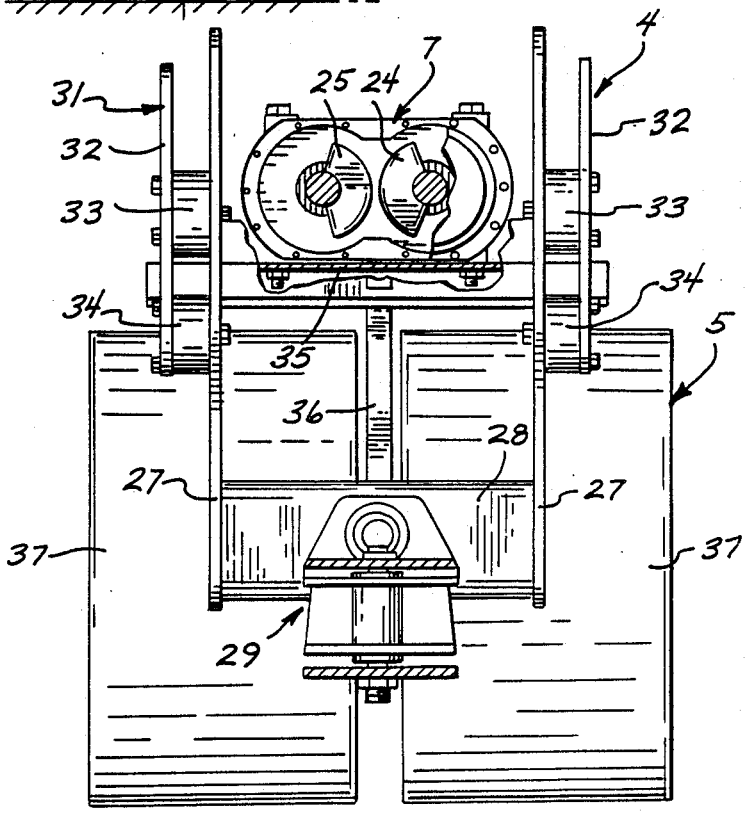
FIG. 5 is a vertical section taken along line 5—5 of FIG. 4.

As best shown in FIGS. 4 and 5, front unit 4 includes a front frame 26 composed of a pair of spaced vertical plates 27, the rear ends of which extend downwardly and are connected together by a generally rectangular beam 28. Beam 29, in turn, is connected to main frame 1 by an articulated joint indicated generally by 29. As set forth in U.S. Pat. No. 4,732,507, joint 29 itself is conventional and permits front frame 26 to pivot about both a horizontal and vertical axes relative to main frame 1. The forward ends of plates 27 are connected by a cross plate 30.

Front unit 4 also includes a drum frame 31 composed of a pair of parallel plates 32 which are located outwardly of the respective plates 27 of frame 26. The forward ends of plates 32 are connected to the corresponding plates 27 by standard resilient isolation mounts 33 that separate plates 31 and 27.

Similarly, the rear ends of plates 32 and 26 are connected by resilient isolation mounts 34. Isolation mounts 33 and 34 act to restrict the transmission of vibrations from drum frame 31 to front frame 26 as well as to main frame 1.

A cross frame 35 connects the lower edges of plates 32 of drum frame 31 and extends beneath the lower edges of plates 27 of frame 26.

Drum frame 31 also includes a central vertical support plate 36 which is secured to cross frame 35 and extends downwardly. As disclosed in U.S. Pat. No. 4,732,507, shaft 6 is journalled on vertical plate 36 and drum 5 consists of a pair of drum sections 37, each being secured to shaft 6 and located on opposite sides of vertical support plate 36.

The vibratory mechanism 7 of the invention is mounted on horizontal plate 8 of cross frame 37 and includes a housing 9 composed of a central section 10 and a pair of end sections 11 and 12 which are connected to the central section by bolts 13. Housing 9 is connected to plate 8 and cross frame 37 by a series of mounting holes 14 which extends through openings in the central section 10 and end section 12 respectively.

A hydraulic motor 15 is mounted on end section 11 and the drive shaft 16 of motor 15 is connected via a coupling 17 to a shaft 18.

Shaft 18 is journalled within bearings 19 that are carried by the central section 10 and end section 12, respectively, of housing 9. As shown in FIG. 3, shaft 18 carries a gear 20 which meshes with a gear 21 of identical diameter that is mounted on shaft 22. Shaft 22 is parallel to shaft 18 and is journalled within bearings 23 that are mounted in the housing sections 10 and 12, respectively.

Shafts 18 and 22 carry eccentric weights 24 and 25 respectively, which extend radially from the axis of the respective shaft. As illustrated in FIG. 2, each weight 24,25 extends through an arc of 90° to 180° and preferably about 160°. The center of mass of each weight is spaced radially from the respective shaft and the center of mass of weight 24 is disposed above and in a vertical plane extending through the axis of shaft 18 when the center of mass of weight 25 is disposed above and in a vertical plane extending through the axis of shaft 22. With this construction, as the shafts 18 and 22 rotate in opposite directions, the vertical vibratory forces generated by eccentric weights 24 and 25 add together to aid in compaction while the horizontal or fore and aft vibratory forces generated by the weights will cancel to minimize transmission of unwanted vibrations to the main frame, thereby reducing wear of the machine and simplifying the shock mount construction as it is only necessary to dampen the vertical vibrations.

As shown in FIG. 4, the vibratory unit 7 is preferably mounted directly above the axis of drum 5, so that the axis of unit 7 lies in a common vertical plane A with the axis of drum 5. The sole connections between front frame 26 and drum frame 31 are through isolation mounts 33, 34, which are located at different horizontal distances from plane A, and these distances are shown by B and C in FIG. 4.

The vertical vibratory forces generated by the eccentric weights 24 and 25 add together in a downward direction to aid in compaction. The downward vibratory force is transmitted through moment arms B and C to drum 5. As the moment arm B, acting through resilient mounts 36, is greater in length than the moment arm C acting through the resilient mounts 34, the difference in moments will tend to rotate the drum counterclockwise, as shown in FIG. 4. This provides a resultant downward force that is acting at an angle D, as shown in FIG. 4, to the vertical, thereby providing a degree of shearing action to the soil to provide increased compaction.

Various modes of carrying out the invention are contemplated as being within the scope of the following claims particularly pointing out and distinctly claiming the subject matter which is regarded as the invention.

I claim:

1. A compaction apparatus, comprising a first frame, a second frame, first resilient means interconnecting said first and second frames, second resilient means interconnecting said first and second frames and spaced from said first resilient means, a means mounted on said second frame and including a pair of eccentric weights constructed and arranged to add vertical vibrational forces generated by said weights and to cancel fore-and-aft vibratory forces, said first resilient means and said second resilient means being offset horizontally from a vertical plane passing through the axis of said drum, said first resilient means being offset a greater distance from said plane than said second resilient means, whereby the downward vertical vibratory forces acting through said offset distances will tend to rotate the drum and subject the soil to a shear type of action.

2. The apparatus of claim 1, wherein said first and second resilient means are located on opposite sides of said plane.

3. The apparatus of claim 1, wherein said first frame comprises a pair of generally parallel first plates and said second frame comprises a pair of generally parallel second plates, said first and second resilient means interconnecting said first and second plates.

4. The apparatus of claim 3, wherein said vibratory means is disposed between said second plates.

5. The apparatus of claim 1, wherein said first resilient means is disposed rearwardly of said plane in the direction of movement of said apparatus and said second resilient means is disposed forwardly of said plane.

6. The apparatus of claim 5, wherein said first resilient means is disposed a greater horizontal distance from said plane than said second resilient means.

7. The apparatus of claim 1, wherein said first and second resilient means comprise generally cylindrical isolation mounts.

8. A compaction apparatus, comprising a first frame, a second frame, first resilient means interconnecting said first and second frames, second resilient means interconnecting said first and second frames and spaced from said first resilient means, a compaction drum mounted on said second frame, vibratory means mounted on said second frame and including a pair of eccentric weights constructed and arranged to add vertical vibrational forces generated by said weights and to cancel fore-and-aft vibratory forces, said first resilient means and said second resilient means being offset horizontally from a vertical plane passing through the axis of said drum, said first resilient means being offset a greater distance from said plane than said second resilient means, the moment generated by said vertical vibratory forces acting through the distance between said first resilient means and said plane being greater than the moment generated by said vibratory forces acting through the distance between said second resilient means and said plane, whereby the unequal moments will tend to rotate the drum and subject the soil to a shear type of action.

9. The apparatus of claim 8, wherein said first and second resilient means comprises generally cylindrical isolation mounts capable of deforming under said vibratory forces.

10. The apparatus of claim 9, wherein the isolation mounts comprise the sole connection between said frames.

11. The apparatus of claim 8, wherein said vibratory means includes power operated means mounted on the second frame, a first shaft operably connected to said power operating means, a second shaft disposed parallel to said first shaft, interconnecting means for interconnecting the shafts and driving the shafts at the same speed and in opposite directions, said weights being connected to the respective shafts in a manner whereby the vertical vibratory forces generated by the weights during rotation of the shaft are added and the horizontal vibratory forces during rotation of said shafts are cancelled.

* * * * *

UNITED STATES PATENT AND TRADEMARK OFFICE

CERTIFICATE OF CORRECTION

PATENT NO. : 4,927,289

DATED : MAY 22, 1990

INVENTOR(S) : THOMAS G. ARTZBERGER

It is certified that error appears in the above-identified patent and that said Letters Patent is hereby corrected as shown below:

Col. 4, line 52, After "a" insert ---compaction drum mounted on said second frame, vibratory---; Col. 6, line 13, After "wherein" delete "the" and insert --said--

Signed and Sealed this

Eighth Day of October, 1991

*Attest:*

*Attesting Officer*

HARRY F. MANBECK, JR.

*Commissioner of Patents and Trademarks*